US009375123B2

(12) United States Patent
Bober et al.

(10) Patent No.: US 9,375,123 B2
(45) Date of Patent: Jun. 28, 2016

(54) FLOOR FINISH APPLICATOR

(75) Inventors: Andrew M. Bober, Racine, WI (US); Lance D. Brown, Racine, WI (US); Glenn N. Weaver, Racine, WI (US)

(73) Assignee: Diversey, Inc., Sturtevant, WI (US)

( * ) Notice: Subject to any disclaimer, the term of this patent is extended or adjusted under 35 U.S.C. 154(b) by 18 days.

(21) Appl. No.: 13/139,632

(22) PCT Filed: Dec. 16, 2009

(86) PCT No.: PCT/US2009/068281
§ 371 (c)(1),
(2), (4) Date: Jun. 14, 2011

(87) PCT Pub. No.: WO2010/077959
PCT Pub. Date: Jul. 8, 2010

(65) Prior Publication Data

US 2011/0244137 A1 Oct. 6, 2011

Related U.S. Application Data

(60) Provisional application No. 61/138,021, filed on Dec. 16, 2008.

(51) Int. Cl.

| | |
|---|---|
| ***A47L 11/04*** | (2006.01) |
| ***A47L 11/22*** | (2006.01) |
| ***A47L 11/40*** | (2006.01) |

(52) U.S. Cl.
CPC ..... *A47L 11/04* (2013.01); *A47L 11/22* (2013.01); *A47L 11/4036* (2013.01); *A47L 11/4055* (2013.01); *A47L 11/4061* (2013.01); *A47L 11/4083* (2013.01)

(58) Field of Classification Search
CPC ..... A47L 11/4069; A47L 11/4038; A47L 11/4075; A47L 11/4041; A47L 11/4058
USPC ..... 15/98, 49.1, 78, 340.1, 340.2, 81, 82; 180/216, 210; 118/108, 305
See application file for complete search history.

(56) References Cited

U.S. PATENT DOCUMENTS 2,979,756 A * 4/1961 Wallis ..... 401/48
3,436,788 A * 4/1969 Tamny ..... 15/385

(Continued)

FOREIGN PATENT DOCUMENTS

EP 0391457 10/1990
JP 52-15057 4/1977

(Continued)

OTHER PUBLICATIONS

The International Search Report prepared by the Korean Intellectual Property Office, date of mailing May 14, 2010.

*Primary Examiner* — Robert Scruggs
(74) *Attorney, Agent, or Firm* — Michael Best & Friedrich LLP

(57) ABSTRACT

One aspect of the present Invention provides a pull-behind floor finish applicator which includes a wheeled cart constructed and arranged to receive a source of floor finish. The wheeled cart includes a selectively moveable floor finish spreader coupled to the cart with a biasing member.

20 Claims, 7 Drawing Sheets

(56) References Cited

U.S. PATENT DOCUMENTS

| | | | | |
|---|---|---|---|---|
| 3,457,015 | A | 7/1969 | Taber | |
| 3,981,596 | A | 9/1976 | Melton | |
| 4,124,315 | A * | 11/1978 | Melton | 401/48 |
| 4,471,713 | A * | 9/1984 | Cote et al. | 118/108 |
| 4,490,873 | A * | 1/1985 | Stratton | 15/50.1 |
| 4,926,515 | A | 5/1990 | Lynn et al. | |
| 5,687,443 | A | 11/1997 | Moore | |
| 5,991,951 | A * | 11/1999 | Kubo et al. | 15/50.1 |
| 6,524,386 | B1 * | 2/2003 | Slager, Sr. | 118/207 |
| 6,618,888 | B2 * | 9/2003 | Joynt et al. | 15/49.1 |
| 2007/0028414 | A1 * | 2/2007 | Young et al. | 15/340.1 |
| 2008/0104783 | A1 * | 5/2008 | Crawford et al. | 15/98 |
| 2008/0279610 | A1 | 11/2008 | Bober et al. | |
| 2009/0022540 | A1 | 1/2009 | Bober et al. | |

FOREIGN PATENT DOCUMENTS

| | | |
|---|---|---|
| JP | H3-55051 | 5/1991 |
| JP | 4-106673 | 9/1992 |
| JP | H8-1661 | 12/1992 |
| JP | H5-39455 | 5/1993 |
| JP | 63-71101 | 3/1998 |
| JP | 02-591730 | 1/1999 |
| JP | 11-267080 | 10/1999 |
| JP | 2003-190064 | 7/2003 |
| JP | 2003190064 | 7/2003 |
| KR | 10-1993-0001871 | 2/1993 |
| WO | WO2008/043013 | 4/2008 |

* cited by examiner

FLOOR FINISH APPLICATOR

FIELD OF THE INVENTION

The present invention relates to applicators for floor finish. More particularly, it relates to a pull-behind floor finish applicator.

BACKGROUND OF THE INVENTION

Pull-behind floor finish applicators are disclosed in U.S. Pat. No. 2,979,756; No. 3,457,015; No. 3,981,596; No. 4,124,315; and No. 4,471,713. Other floor finish applicators of this type are available from Fast-Trak Inc. as Ultra-Trak floor finish applicator and Hillyard, Inc. of St. Joseph, Mo. as Multi-Flo applicator.

SUMMARY OF THE INVENTION

One aspect of the present invention provides a pull-behind floor finish applicator which includes a wheeled cart constructed and arranged to receive a source of floor finish. The wheeled cart includes a selectively moveable floor finish spreader coupled to the cart with a biasing member.

One aspect of the invention relates to a floor finish applicator having a wheeled cart including a body member constructed and arranged to receive a source of floor finish; a floor finish spreading mop coupled to the cart; a first elongate element coupled between the cart and a proximal end of the spreading mop; a second elongate element coupled between the cart and a distal end of the spreading mop, wherein the spreading mop is coupled to the first and second elongate elements for rotation about a horizontal axis; a first elastic element coupled to a first end of the spreading mop; and a second elastic element coupled to a second end of the spreading mop; wherein the spreading mop is rotatable about a vertical axis in response to the first and second elastic elements, when the spreading mop encounters an obstacle.

One aspect of the invention relates to a floor finish applicator having a spreading device selectively moveable between a position engaged with a floor and a position not engage with the floor, wherein the spreading device is held in each position by an over-center mechanism. Another aspect of the invention relates to a method of applying floor finish to a floor using the device described above.

One aspect of the invention relates to a floor finish applicator having a spreading device selectively biased into engagement with the floor, wherein the bias force cause the leading edge of the spreading device to engage the floor with less force than the trailing edge of the spreading device. Another aspect of the invention relates to a method of applying floor finish to a floor using the device described above.

Further aspects of the present invention, together with the organization and operation thereof, will become apparent from the following detailed description of the invention when taken in conjunction with the accompanying drawings.

Figure 1:
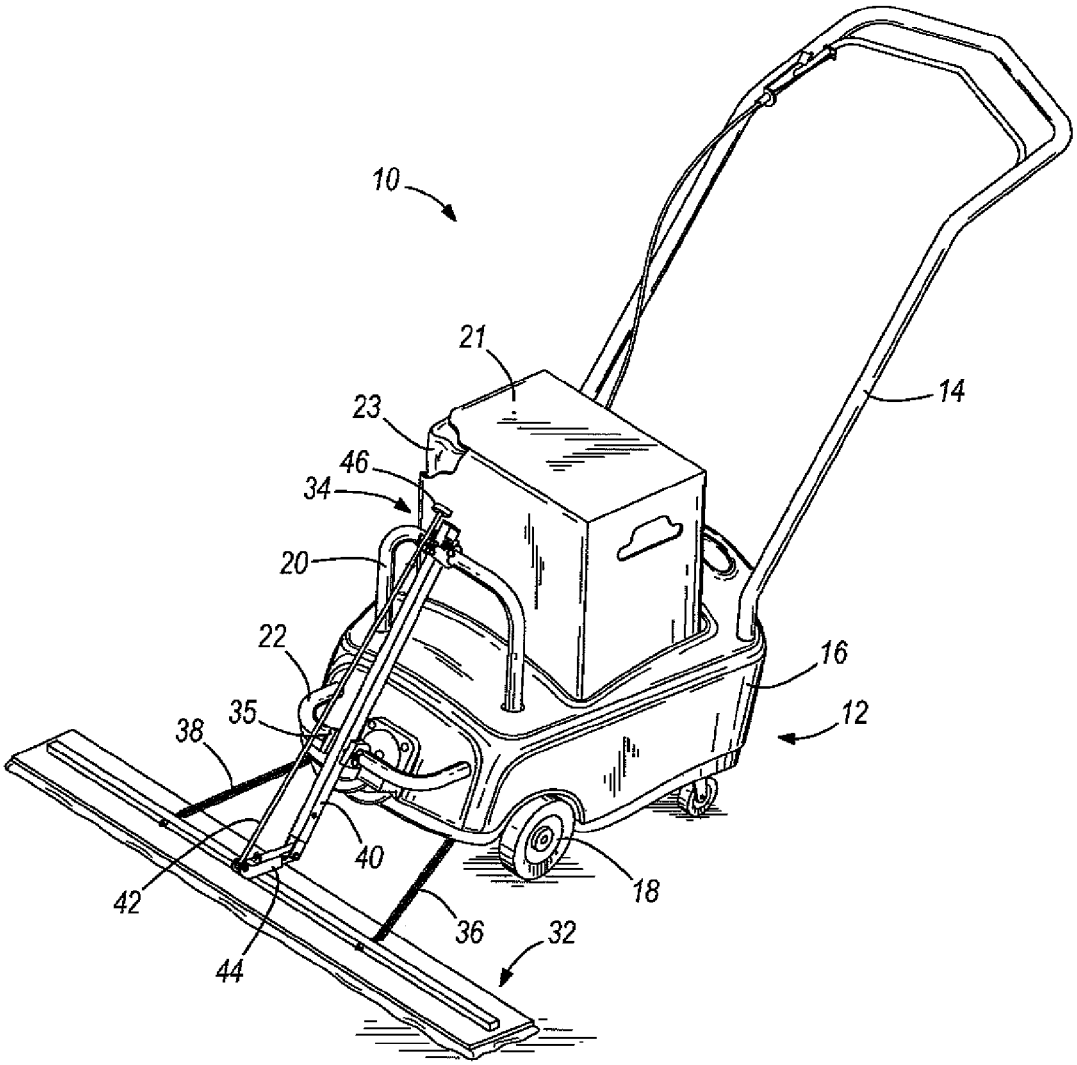
FIG. 1 is a perspective view of the floor finish applicator embodying aspects of this invention having a spreader or applicator.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising," or "having" and variations thereof herein is meant to encompass the items listed thereafter and equivalents thereof as well as additional items. The terms "mounted," "connected," and "coupled" are used broadly and encompass both direct and indirect mounting, connecting and coupling. Further, "connected" and "coupled" are not restricted to physical or mechanical connections or couplings, and can include electrical connections or couplings, whether direct or indirect. Finally, as described in subsequent paragraphs, the specific mechanical configurations illustrated in the drawings are intended to exemplify embodiments of the invention. Accordingly, other alternative mechanical configurations are possible, and fall within the spirit and scope of the present invention.

DESCRIPTION OF THE ILLUSTRATED EMBODIMENTS

A floor finish applicator 10 embodying aspects of the invention is shown in the figures. The floor finish applicator 10 includes a moveable frame or cart 12 with a handle 14 joined to a base 16 of the cart 12. Wheels 18 are rotatably mounted on the base 16 of the cart 12. The cart 12 is also adapted to hold a container of floor finish, such as a box 21 with a bag 23 containing floor finish as illustrated. A conduit delivers the floor finish from the container to the floor. A spreading mechanism 32 is coupled to the cart 12 to spread, distribute, and/or level the floor finish on a floor when dispensed.

Various means of delivering floor finish to the floor can be utilized with the present invention, such as, for example, any of the means described in U.S. 2008/0279610 and U.S. patent application Ser. No. 11/780,705 (filed Jul. 20, 2007), the entire descriptions of which are hereby incorporated by reference.

Figure 2:
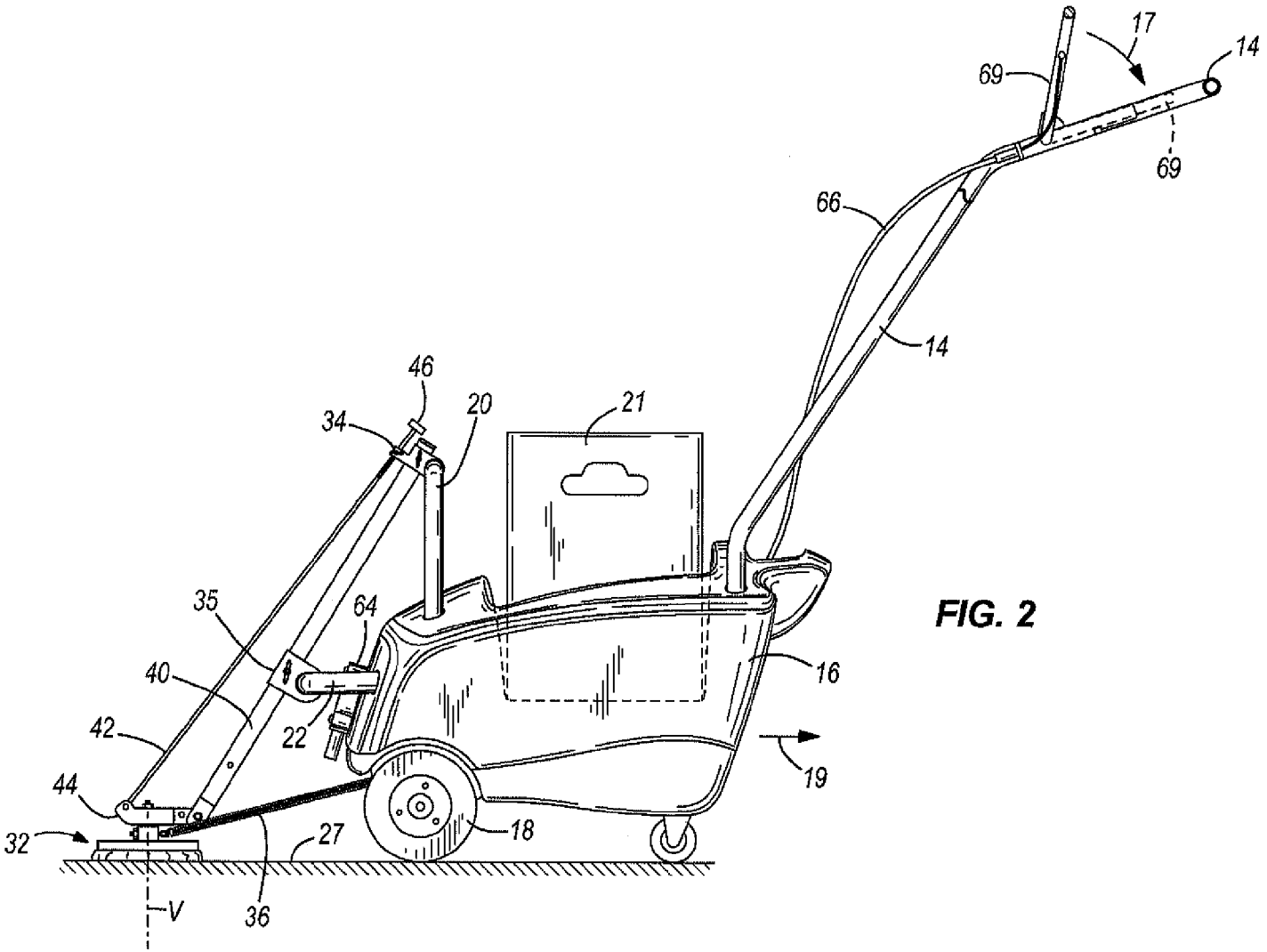
FIG. 2 is a side view of the applicator illustrated in FIG. 1.

Referring now to FIGS. 1 and 2, it can be seen that the spreader 32 is connected to the housing 16 via frame members 20 and 22 with clamps 34 and 35. Various means for connecting the spreader to the cart 12 can be utilized. In some embodiments, such as the one illustrated, the spreader 32 can be a mop head having a pad adapted to spread and leveling the floor finish. For example, the pad can be made of foam, flocked foam, woven or non-woven cloth.

First and second elastic members 36, 38 are coupled between the housing 16 and the spreader 32, as shown in the Figures. In the illustrated embodiment, the elastic members 36, 38 are springs, but in other embodiments, the elastic members can be rubber bands, bungee cords, or any other similar elastic element, The first elastic member 36 can be coupled to a first side of the spreader 32, whereas the second elastic member 38 can be coupled to a second side of the spreader 32.

Figure 3:
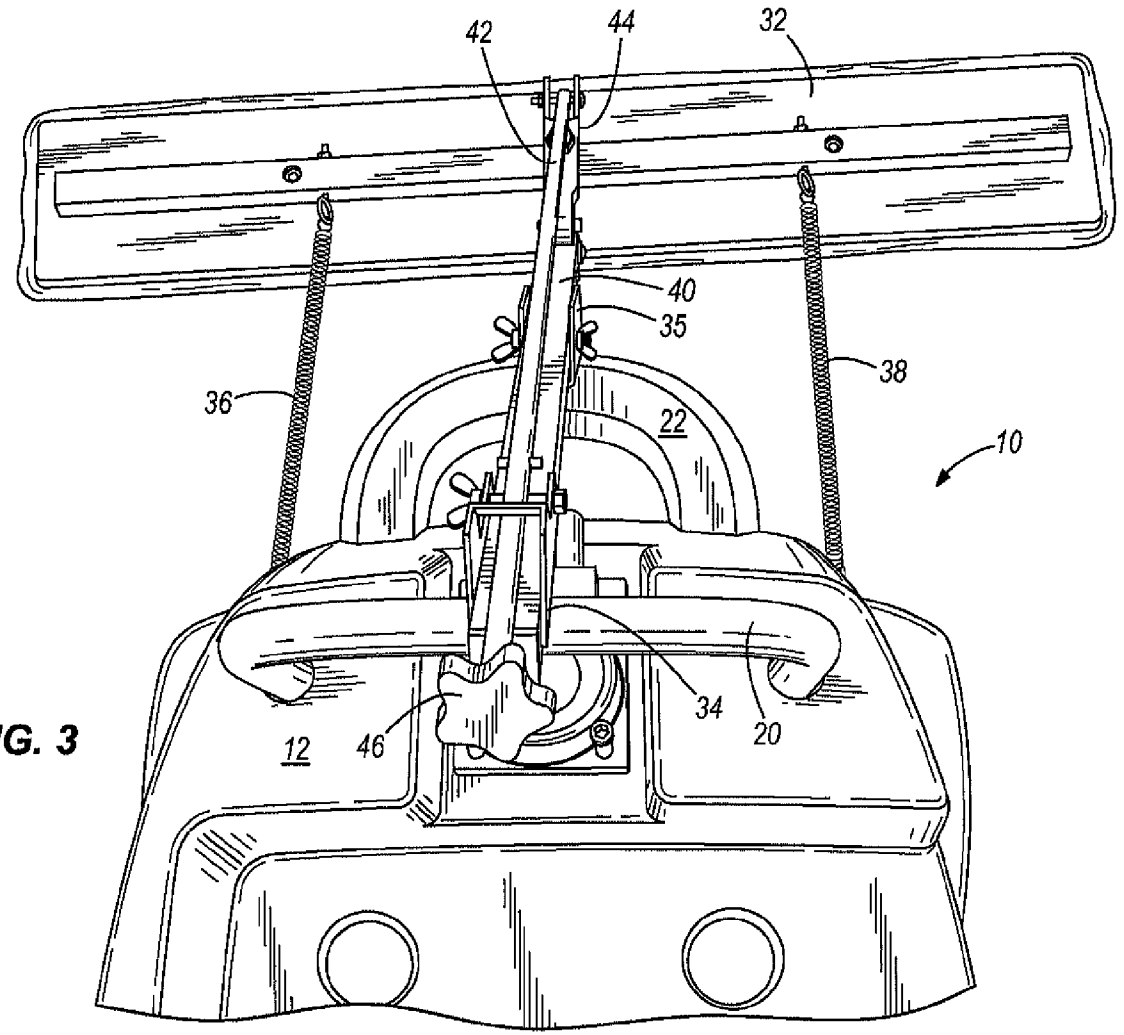
FIG. 3 is a top view of the applicator illustrated in FIG. 1 with the spreader in an at rest position.
Figure 4:
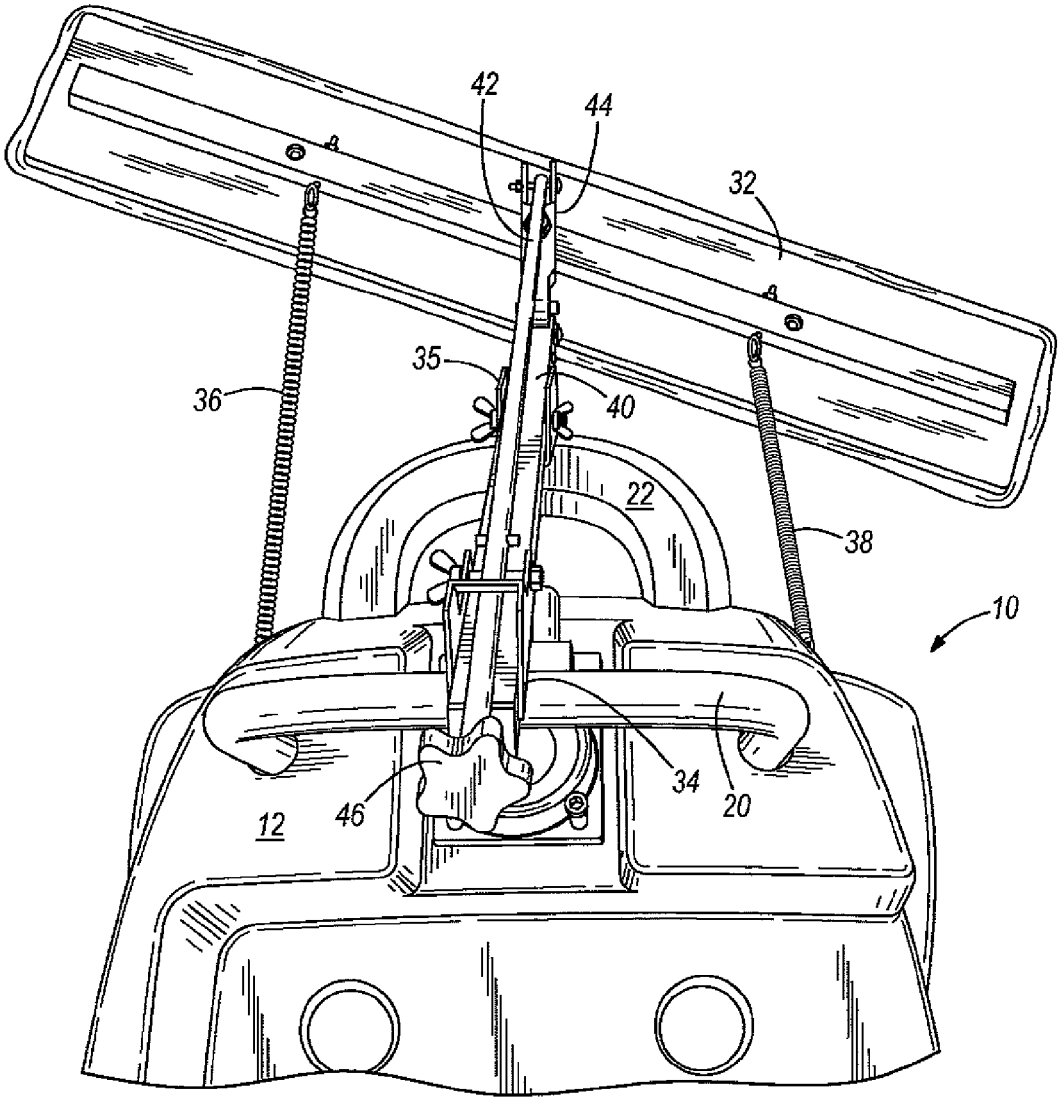
FIG. 4 is a top perspective view of the applicator shown in FIG. 1 with the spreader/applicator in a rotated position.
Figure 5:
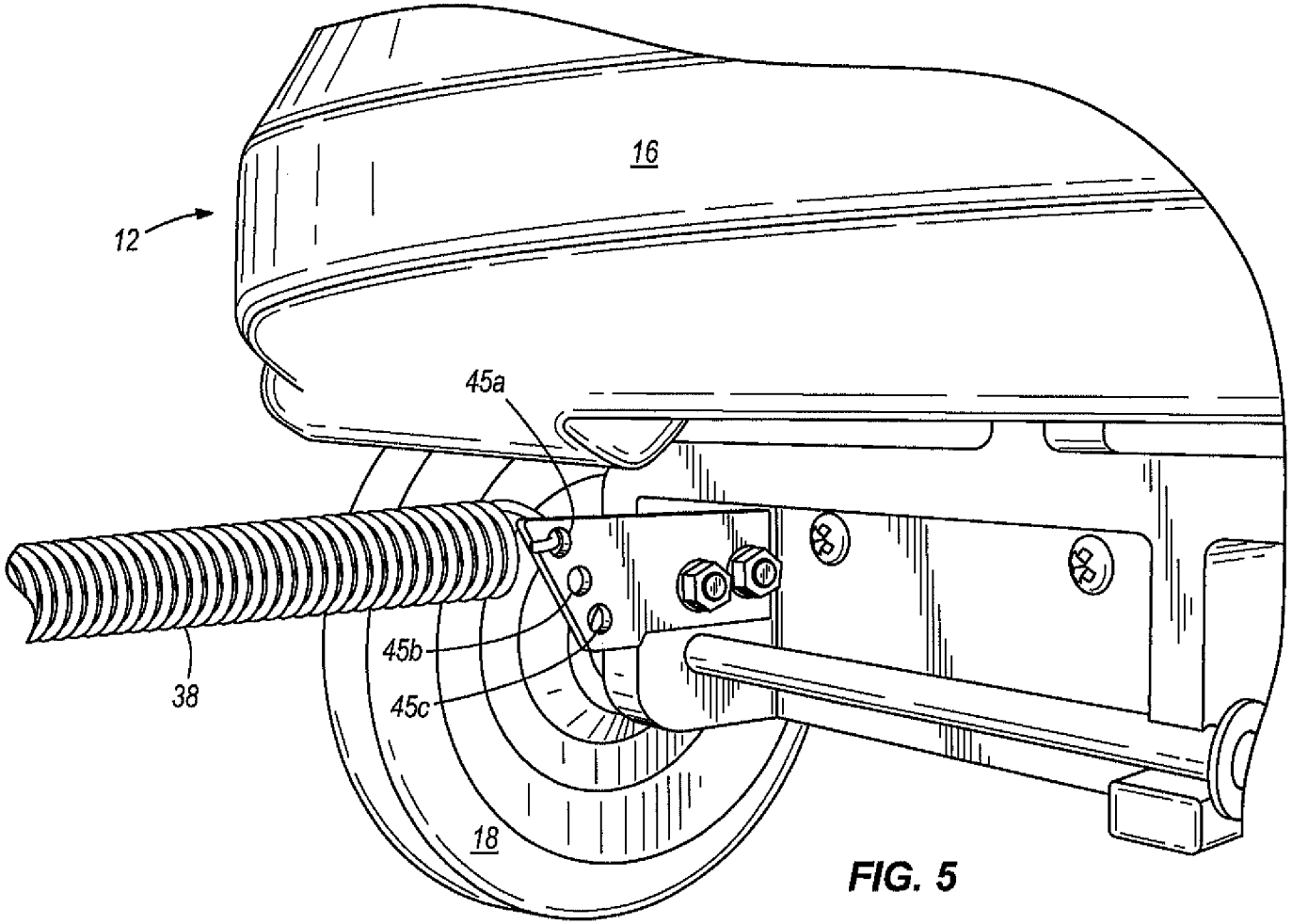
FIG. 5 is a detailed view of a connection including an elastic member between the applicator and the spreader.

In the illustrated embodiment, a first elongate element 40 is coupled to the spreader 32 and the clamps 34, 35, and a second elongate element 42 is coupled to the spreader 32 and the clamp 34. The first and second elastic member 36, 38 are positioned on either side of the first and second elongate elements 40, 42. The first and second elastic elements 36, 38 bias the spreader 32 toward the housing 16, and permit rotation about a substantially vertical axis V (relative to the floor 27) when the spreader 32 encounters obstacles, such as in FIGS. 3 and 4. Tension in the elastic members 36, 38 can be adjusted by attaching the elastic members 36, 38 to any of a variety of attachment locations, such as apertures 45*a*, 45*b*, 45*c*, see FIG. 5. The apertures 45*a*, 45*b*, 45*c* are positioned at differing horizontal locations with respect to the base 16, to provide different biasing forces to the spreader 32. The first and second elastic elements 36, 38 bias the spreader 32 back into the position shown in FIG. 3. Alternatively, other tension adjustment means can be utilized, such as by moving the connection point of the elastic elements (e.g., threading the I-bolt on the spreader).

The first elongate element 40 can be coupled to a proximate edge P of the spreader 32, whereas the second elongate element 42 can be coupled to a distal edge D of the spreader 32. A support element 44 can be coupled to the spreader 32 and can permit rotation of the spreader 32 about a substantially vertical axis V with respect to the support element 44, as discussed above. The first and second elongate elements 40, 42 can be coupled to the support element 44, to selectively rotate the spreader 32 about a horizontal axis at point H. An actuator, such as knob 46 can be coupled to the second elongate element 42 to permit actuation or movement of the spreader 32. Other actuators, user-manipulable controls, electronic devices, and the like can be utilized in place of, or in addition to knob 46, to rotate the spreader 32. Movement of the knob 46 causes rotation of the spreader 32 about point H between a floor-engaging or operating position, shown in FIG. 6 and a non-operating position, shown in FIG. 7, in which the spreader 32 is spaced from a floor surface 27 (see FIG. 1).

Figure 6:
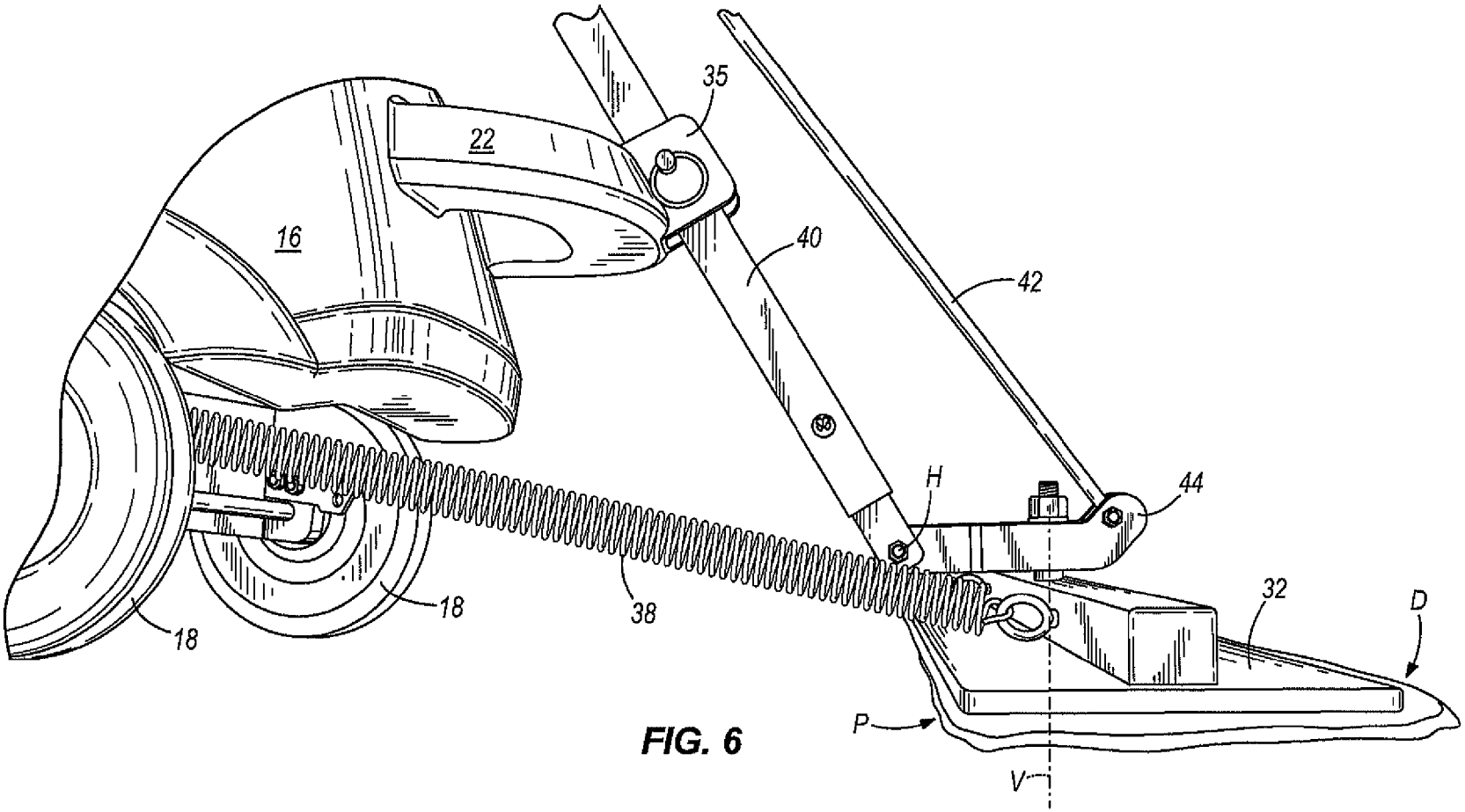
FIG. 6 is a side view of the spreader of FIG. 1 in an operating position.

When the spreader 32 is in the operating position, the arrangement of the elastic elements 36, 38 and the elongate elements 40, 42 is over-center (relative to pivot point H), such that the spreader 32 is biased in a clockwise direction by the elastic elements 36, 38, see FIG. 6. The clockwise biasing creates a larger downward force on the distal edge D and a smaller downward force on the proximal edge P. The smaller force on the proximal edge P permits floor finish to move more easily under the spreader 32, and the larger force on the distal edge D enhances spreading of the floor finish along the floor surface.

Figure 7:
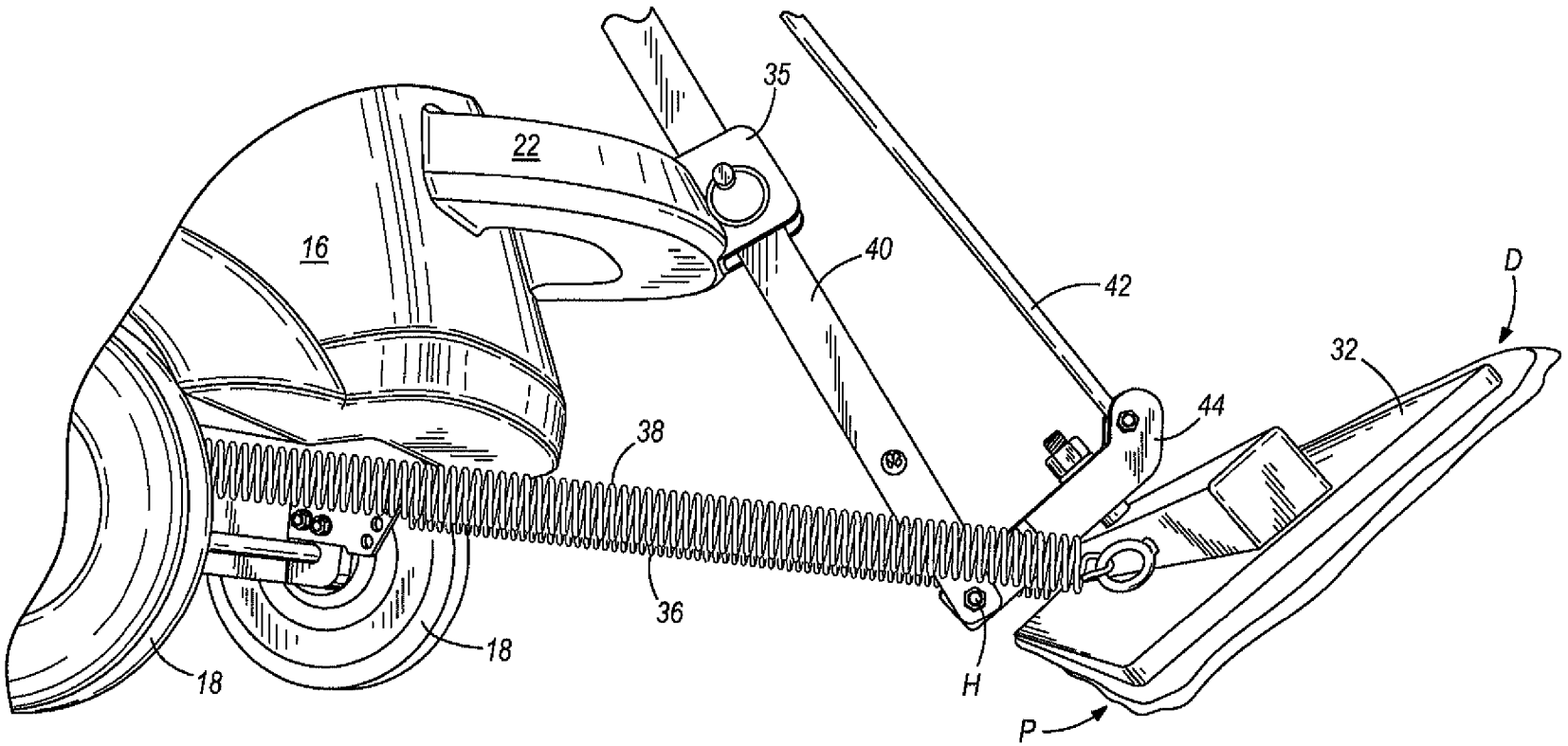
FIG. 7 is a side view of the spreader of FIG. 1 in an non-operating position.

When it is desired to move the floor finish applicator 10 without spreading floor finish on the floor, the knob 46 is pulled upward, to thus pivot the spreader 32 counterclockwise, out of engagement with the floor, see FIG. 7. The spreader 32 rotates over-center (relative to pivot point H), such that the spreader 32 is biased in a counterclockwise direction by the elastic elements 36, 38. The geometry of the spreader 32 and various support elements creates over-center rotation, such that the spreader 32 is maintained in the operating position and the non-operating position by the elastic elements 36, 38, without the use of locks, detents, ratchets and the like. Use of detents or other similar locking mechanisms can be used in non-illustrated embodiments.

A further understanding of the floor finish applicator 10 can be had by a description of its operation as seen in the figures The container containing floor finish in placed onto the housing 16 of cart 12 as illustrated in FIG. 1 and the container is connected to a conduit adapted to deliver the floor finish to the floor. Once the floor finish applicator 10 is placed in its operating location, the spreader 32 can be moved into engagement with the floor. Specifically, the knob 46 can be pressed downward to rotate the spreader 32 about point H from the non-operating position of FIG. 7 to the operating position of FIG. 6. With respect to the illustrated embodiment, when it is desired to dispense floor finish from the container onto the floor surface, an actuator, such as a bail 69 is actuated to deliver floor finish to the floor as the cart is moved across the floor. The elastic elements 36, 38 permit rotation about vertical axis V, when the spreader 32 encounters obstacles, corners, and the like, see FIG. 4. Upon completion, the spreader 32 can be moved out of engagement with the floor. Specifically, the knob 46 is pulled upward to pivot the spreader 32 about point H to move the spreader 32 from the operating position to the non-operating position. The elastic elements 36, 38 move over-center to "lock" into the operating position and the non-operating position without the use of detents, locks, ratchets or other similar locking mechanisms.

As discussed above, the elastic elements 36, 38 on the spreader 32 can result in certain advantages during operation. For example, the spreader 32 can rotate about axis V to hug corners without being square to corner, or if the spreader 32 encounters obstacles. This prevents or limits damage that can occur during operation, as the floor finish applicator 10 is navigated around objects, corners and the like. The elastic elements 36, 38 return the spreader 32 to center, after the spreader 32 is moved past or away from various obstacles.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention. For example, various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

Various features of the invention are set forth in the following claims.

What is clamed is:

1. A floor finish applicator comprising:

a wheeled cart;

a floor finish spreading mop coupled to the cart;

a first elastic element coupled to a first end of the spreading mop;

a second elastic element coupled to a second end of the spreading mop; and an actuator coupled to the spreading mop between the first elastic element and the second elastic element to selectively raise and lower the spreading mop, the actuator configured to rotate the spreading mop about a horizontal axis between a position engaged with a floor and a position disengaged from the floor;

wherein the spreading mop is rotatable from a first position to a second position about a vertical axis defined by the actuator when the spreading mop encounters an obstacle, and wherein the spreading mop is rotatable from the second position back to the first position via the first and second elastic elements, wherein the spreading mop is selectively biased into engagement with the floor by the first and second elastic elements such that the bias force causes a leading edge of the spreading mop to engage the floor with less force than a trailing edge of the spreading mop, wherein at least a portion of each of the first and second elastic elements extends below the horizontal axis in the floor-engaged position of the spreading mop, the first and second elastic elements exerting a force in this orientation to hold the spreading mop in the floor-engaged position, wherein at least a portion of each of the first and second elastic elements extends above the horizontal axis in the floor-disengaged position of the spreading mop, the first and second elastic elements exerting a force in this orientation to hold the spreading mop in the floor-disengaged position.

2. A method of applying floor finish to a floor using the device of claim 1.

3. The floor finish applicator of claim 1, wherein the first and second elastic elements are coupled to a rearward end of the wheeled cart in the direction of travel of the cart when the spreading mop is in a floor-engaged position.

4. The floor finish applicator of claim 1, wherein the first and second elastic elements bias the spreading mop to the first position.

5. The floor finish applicator of claim 4, wherein the first and second elastic elements are adjustable to control the bias force applied to the spreading mop.

6. The floor finish applicator of claim 1, wherein the vertical axis extends through the spreading mop.

7. The floor finish applicator of claim 1, wherein the cart includes multiple attachment points for each of the first elastic element and the second elastic element to adjust the bias force applied to the spreading mop by the first and second elastic elements.

8. A floor finish applicator comprising:

a wheeled cart;

a floor finish spreading mop coupled to the cart and having a proximal edge and a distal edge relative to the cart; and an over-center mechanism coupled to the floor finish spreading mop, the over-center mechanism including a first elongate element extending from the cart toward the spreading mop such that an end of the first elongate element is positioned closer to the proximal edge than the distal edge; and a second elongate element extending from the cart toward the spreading mop such that an end of the second elongate element is positioned closer to the distal edge than the proximal edge;

wherein the spreading mop is coupled to the first and second elongate elements for over-center rotation about a horizontal axis between a position engaged with a floor and a position not engaged with the floor, wherein at least one of the first elongate element and the second elongate element is movable relative to the other elongate element to move the spreading mop about the horizontal axis over-center to each position such that the spreading mop is held in each position at least partially by the relative arrangement of the first and second elongate elements.

9. A method of applying floor finish to a floor using the device of claim 8.

10. The floor finish applicator of claim 8, further includes an elastic element extending between the cart and the spreading mop, and wherein the elastic element cooperates with the first and second elongate elements to bias the spreading mop into engagement with the floor.

11. The floor finish applicator of claim 10, wherein the over-center mechanism biases the spreading mop into engagement with the floor to cause a leading edge of the mop to engage the floor with less force than a trailing edge of the mop.

12. The floor finish applicator of claim 10, wherein at least a portion of the elastic element extends below the horizontal axis in the floor-engaged position of the spreading mop.

13. The floor finish applicator of claim 12, wherein at least a portion of the elastic element extends above the horizontal axis in the floor-disengaged position of the spreading mop.

14. The floor finish applicator of claim 8, further comprising a support element coupled to the spreading mop, wherein the first elongate element is coupled to the support element adjacent a first end of the of the support element and the second elongate element is coupled to the support element adjacent a second end of the support element, and wherein the horizontal axis is defined adjacent the connection between the first elongate element and the support element.

15. The floor finish applicator of claim 14, further comprising an actuator element coupled to a distal end of the second elongate element to move the spreading mop between the two positions.

16. The floor finish applicator of claim 8, wherein the over-center mechanism includes an elastic element extending between the cart and the spreading mop and cooperating with the first and second elongate elements to hold the spreading mop in the floor-disengaged position.

17. The floor finish applicator of claim 8, wherein both of the first elongate element and the second elongate element extend from the cart to the spreading mop within a single vertical plane.

18. The floor finish applicator of claim 8, wherein the over-center mechanism further includes a support element extending between and coupled to the first elongate element and the second elongate element, and wherein the spreading mop is coupled to the first and second elongate elements by the support element for rotation about the horizontal axis.

19. The floor finish applicator of claim 8, wherein the first elongate element defines a pivot point of the over-center mechanism through which the horizontal axis extends.

20. The floor finish applicator of claim 8, wherein the first elongate element extends to a location forward of the point of attachment between the spreading mop and the over-center mechanism, and wherein the second elongate element extends to a location rearward of the point of attachment between the spreading mop and the over-center mechanism.

* * * * *